US008596960B1

(12) United States Patent
Pelfrey

(10) Patent No.: US 8,596,960 B1
(45) Date of Patent: Dec. 3, 2013

(54) TURBOPUMP WITH A TAPERED HYDROSTATIC BEARING

(75) Inventor: Philip C. Pelfrey, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 375 days.

(21) Appl. No.: 12/941,338

(22) Filed: Nov. 8, 2010

(51) Int. Cl.
*F01D 25/22* (2006.01)

(52) U.S. Cl.
USPC ..... 415/111; 416/174

(58) Field of Classification Search
USPC ..... 415/229, 170.1, 142, 110, 111, 904, 415/112, 113; 416/174; 417/423.12; 384/100, 107, 110
See application file for complete search history.

(56) References Cited

U.S. PATENT DOCUMENTS 4,884,899 A * 12/1989 Schwartzman ..... 384/100

* cited by examiner

*Primary Examiner* — Edward Look
*Assistant Examiner* — Juan G Flores
(74) *Attorney, Agent, or Firm* — John Ryznic

(57) ABSTRACT

A tapered hydrostatic bearing assembly with a rotor shaft rotating about a stationary shaft in which two tapered hydrostatic bearings are formed to rotatably support the rotor shaft. The stationary shaft includes a bearing fluid passage to channel the bearing fluid to the two tapered hydrostatic bearings. The tapered bearings also function as axial thrust bearings for the rotor shaft.

8 Claims, 4 Drawing Sheets

TURBOPUMP WITH A TAPERED HYDROSTATIC BEARING

GOVERNMENT LICENSE RIGHTS

This invention was made with Government support under contract number FA9300-07-C-0001 awarded by the US Air Force. The Government has certain rights in the invention.

CROSS-REFERENCE TO RELATED APPLICATIONS

None.

BACKGROUND OF THE INVENTION

1. Field of the Invention

The present invention relates generally to a turbopump for a rocket engine, and more specifically to a tapered hydrostatic bearing for a turbopump.

2. Description of the Related Art Including Information Disclosed Under 37 CFR 1.97 and 1.98

Turbopumps operate at high rotating speeds to maximize efficiency and reduce size and weight. Additionally, they are often designed to operate over a wide throttle range (speed range) and to be reusable for up to 50-100 missions. Current rotor support systems often experience rotor dynamics instabilities, which can require the identification of "stay out" zones and limit the operating throttle range. Additionally, bearings fail due to excessive wear or excessive loading due to these rotor dynamic instabilities or cavitation induced dynamic loading.

Conventional rotor support systems mount the pumping and/or turbine element(s) on a rotating shaft supported by rolling element or hydrostatic bearings. The inner rings of the rolling element bearing are mounted to the shaft and rotate with the shaft. The outer ring is mounted in the housing and has an anti-rotation feature. The hydrostatic bearing (orifice and pocket) is mounted in the housing, is non-rotating, and is supplied with high-pressure fluid from the pump discharge from the outer diameter of the bearing, making it an external-fed hydrostatic bearing. The hydrostatic bearing journal is typically the outer diameter of the shaft or shaft mounted sleeve.

In both of these configurations, the shaft and bearing diameters must be sized to fit within the inner annulus line of the flow path. The small shaft and bearing diameters result in rigid body and bending mode critical speeds that make it extremely challenging to achieve a stable and robust rotor support system that has long-life and the ability to throttle over a wide speed range.

Additionally, turbopumps that have used externally-fed hydrostatic bearings, have relied on either a rolling element ball bearing, rub stop, or a hydrostatic thrust bearing to react transient axial loads. This additional bearing or rub stop introduces another potential component to fail and reduces the reliability of the turbopump. Additionally, the wear associated with the rub stop limits the ability of the turbopump to throttle below the pressurization point of the balance piston, which prohibits its use on long-life deep throttling turbopumps.

BRIEF SUMMARY OF THE INVENTION

An internally-fed tapered hydrostatic bearing to eliminate the need for a rolling element bearing, rub stop, or hydrostatic thrust bearing that can be used in an inducer for a turbopump used in a rocket engine, where the inducer is rotatably supported by a hydrostatic bearing configuration. There are a variety of options for angle of the bearing, placement of the pocket axially, the pocket shape, axial and circumferential position of the orifice within the pocket, as well as tangential and axial injection angles of the orifice. These parameters can be varied to tune axial and radial stiffness and load capacity, as well as to prescribe desired flow splits between left and right vents—even compensate for asymmetric vent pressures. A rotor support system is shown in which the bearings are shown opposing each other; however, with the thrust load always in one direction, the bearings could be tapered in the same direction to provide twice the load capacity.

DETAILED DESCRIPTION OF THE INVENTION

Figure 1:
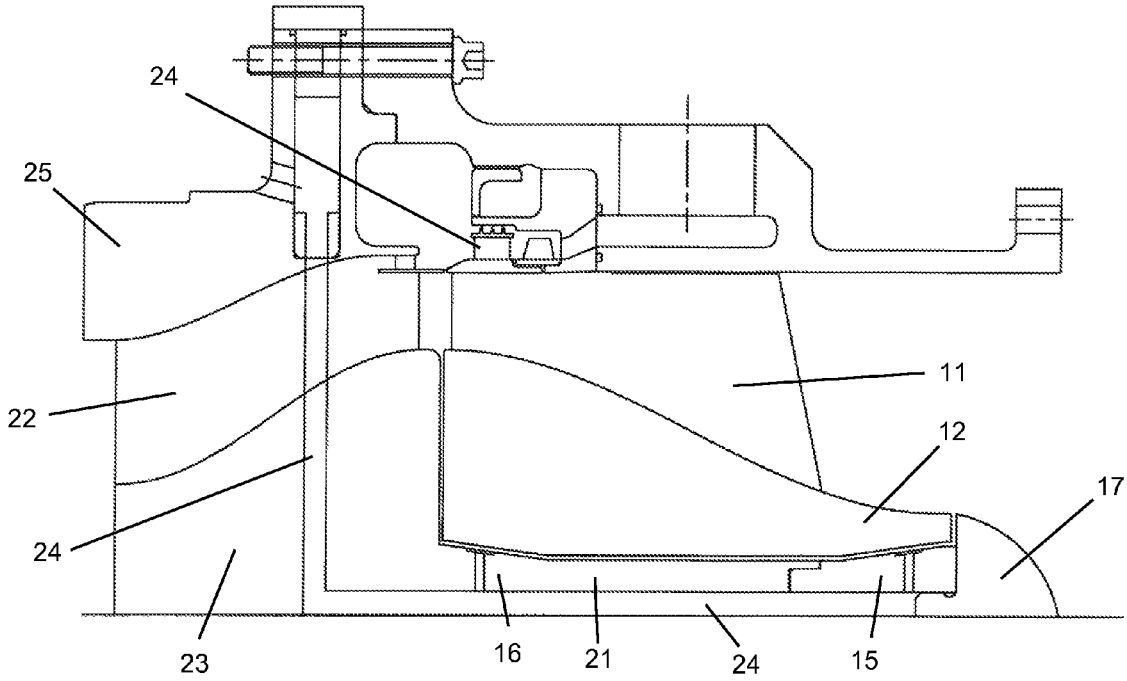
FIG. 1 shows a rotor mounted on stationary shaft with internally fed tapered hydrostatic bearing of the present invention.

A tapered hydrostatic bearing to support a rotor such as an inducer for a turbopump like one used in a rocket engine in which the inducer supplies a lower pressure liquid to an inlet of a higher pressure impeller. An example rotor is shown in FIG. 1 and includes an impeller main stage 11 extending from a hub 12. The two ends of the hub 12 are rotatably supported by a forward internally fed tapered hydrostatic bearing 15 and an aft internally fed tapered hydrostatic bearing 16 formed between an inner surface of the hub 12 and an outer surface of an adjacent extension from a stator, such as a vane hub 21. The forward bearing 15 forms an extension of the stator vane hub extension 21. The invention is described for use in an inducer and stator vane inlet guide for a rocket engine. However, the invention can be used in any rotor with a hydrostatic bearing.

The inducer hub 12 has a central opening about a rotational axis of the inducer in which the stator vane hub extension fits within. A hub end 17 threads onto the hub extension 21 and secures the inducer hub 12 axially. Fluid from the inducer flows through a stator vane 22 that extends from a stator vane hub 23 and rotates within a stator 25 housing in which the fluid flows into a higher pressure impeller (not shown). A high pressure supply line 24 passes through the stator vane assembly (including the hub 23 and the hub extension 21) to channel high pressure fluid from the impeller outlet to the two hydrostatic bearings 15 and 16. The forward bearing 15 fits over the end of the stator vane hub extension 21 so that the inducer hub can be fitted onto the hub extension 21. Because of the slanted surfaces of the two bearings 15 and 16, the forward bearing 15 must be a separate piece in order to assemble the inducer to the stator vane assembly.

In the FIG. 1 embodiment, the two tapered hydrostatic bearings 15 and 16 are each slanted toward the inner side of the inducer or away from the ends of the hub extension 21 in order to center the inducer hub 12 during operation. Fluid supplied from the two bearings 15 and 16 will then flow into the inducer to be pumped to the stator vane 22.

Figure 2:
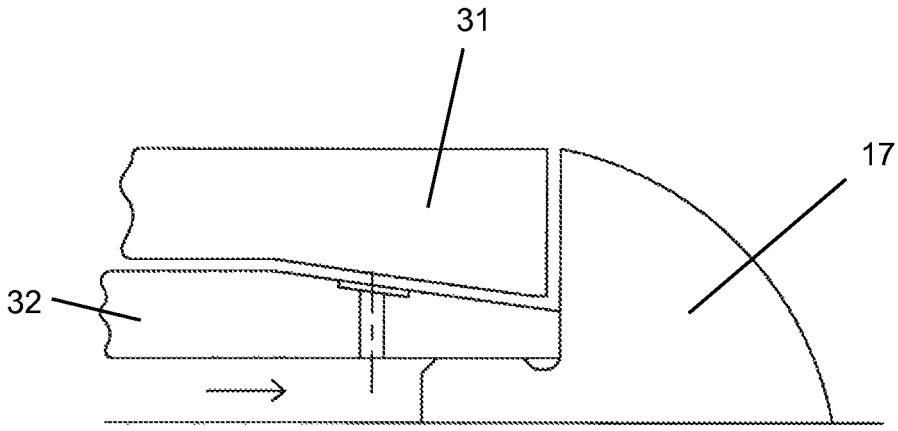
FIG. 2 shows another embodiment of the internally fed tapered hydrostatic bearing of the present invention.
Figure 3:
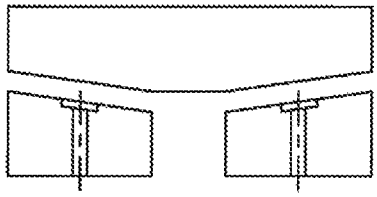
FIGS. 3 through 6 shows various embodiments of the internally fed tapered hydrostatic bearing arrangement of the present invention.

In FIG. 2, the tapered hydrostatic bearing is slanted outward in an opposite direction to that shown in the forward tapered hydrostatic bearing 15 in the FIG. 3 embodiment. FIGS. 3 through 6 show other embodiments for the two tapered hydrostatic bearings used to rotatably support the inducer of FIG. 3.

Figure 4:
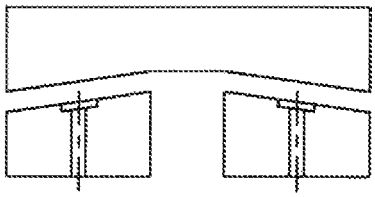
Figure 5:
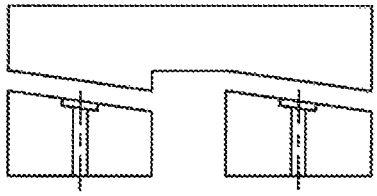
Figure 6:
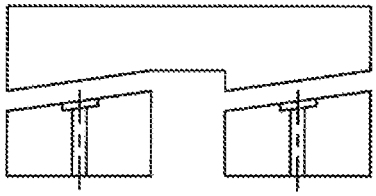

The FIG. 3 embodiment is similar to that shown in FIG. 1 in which the tapered bearings slant inward. In FIG. 4, the two tapered bearings slant outward. For the FIG. 4 bearing assembly, the hub extension would have to be a separate piece from the stator vane hub in order to assembly the aft bearing within the inducer central opening. In FIG. 5, the two tapered bearings both slant toward the inlet side while in FIG. 6 they slant toward the outlet side of the inducer. In the FIGS. 5 and 6 embodiments, a step or abutment is used to prevent axial movement of the inducer with respect to the hub extension.

Figure 7:
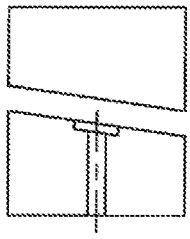
FIG. 7 through 10 shows various embodiments of the individual tapered hydrostatic bearing with the fluid passage.
Figure 8:
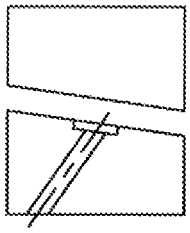
Figure 9:
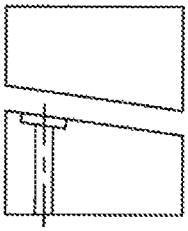
Figure 10:
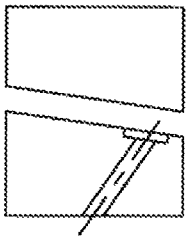

In FIGS. 7 through 10, various arrangements are shown for the tapered hydrostatic bearing with the fluid passage to supply the bearing fluid. FIG. 7 shows a radial bearing, FIG. 8 shows an opposed bearing, FIG. 9 shows an offset bearing, and FIG. 10 shows an offset and opposed bearing.

I claim the following:

1. An inducer and stator vane assembly comprising:

an inducer hub having a central opening;

an inducer blade extending outward from the inducer hub;

a stator vane hub located downstream and adjacent to the inducer hub;

a stator vane hub extension extending into the central opening of the inducer hub;

a stator vane extending outward from the stator vane hub;

an inner surface of the inducer hub and an outer surface of the stator vane hub extension forming a forward and an aft tapered hydrostatic bearing that rotatably supports the inducer hub on the stator vane hub extension with a fluid pressure.

2. The inducer and stator vane assembly of claim 1, and further comprising:

the forward tapered hydrostatic bearing is formed as a separate piece from the stator vane hub extension.

3. The inducer and stator vane assembly of claim 2, and further comprising:

a hub end is secured to the stator vane hub extension to secure the forward tapered hydrostatic bearing to the stator vane hub extension.

4. The inducer and stator vane assembly of claim 1, and further comprising:

a high pressure fluid passage formed within the stator vane hub and the stator vane hub extension to channel fluid to the forward and aft tapered hydrostatic bearings.

5. The inducer and stator vane assembly of claim 1, and further comprising:

the inducer central opening includes a forward slanted surface and an aft slanted surface that forms surfaces for the hydrostatic bearing fluid to react.

6. The inducer and stator vane assembly of claim 1, and further comprising:

the forward and aft tapered hydrostatic bearings are inward facing bearings, or outward facing bearings, or right facing bearings, or left facing bearings.

7. The inducer and stator vane assembly of claim 1, and further comprising:

the fluid passage in the tapered hydrostatic bearing is a radial passage, or an opposed passage, or an offset passage, or an offset and opposed passage.

8. A tapered hydrostatic bearing comprising:

a stationary shaft;

a bearing fluid passage within the stationary shaft;

a rotor shaft mounted on the stationary shaft for rotation thereon;

a forward tapered hydrostatic bearing on a forward side of the stationary and rotor shafts;

an aft tapered hydrostatic bearing on an aft side of the stationary and rotor shafts; and, the forward and aft tapered hydrostatic bearings being connected to the bearing fluid passage; and, the aft tapered hydrostatic bearing is a separate piece from the stationary shaft.

* * * * *